US005579550A

United States Patent [19]

Bathrick et al.

[11] Patent Number: 5,579,550

[45] Date of Patent: Dec. 3, 1996

[54] ARTICULATED BED WITH COLLAPSIBLE FRAME

[75] Inventors: Leeland M. Bathrick, Crystal Lake; Glenn Brittain, McHenry, both of Ill.

[73] Assignee: C.E.B. Enterprises, Inc., Mundelein, Ill.

[21] Appl. No.: 308,411

[22] Filed: Sep. 19, 1994

[51] Int. Cl.[6] ..... A61G 7/002; A61G 7/015

[52] U.S. Cl. ..... 5/620; 5/618; 5/184

[58] Field of Search ..... 5/620, 600, 613, 5/616, 617, 618, 184, 202, 181

[56] References Cited

U.S. PATENT DOCUMENTS 4,381,571 5/1983 Elliott ..... 5/620
4,679,261 7/1987 Stanley et al. ..... 5/184
4,685,160 8/1987 Rizzardo ..... 5/620
5,063,623 11/1991 Bathrick et al. ..... 5/618
5,438,723 8/1995 Carroll ..... 5/620

*Primary Examiner*—Alexander Grosz

[57] ABSTRACT

An improved articulated bed with linearly retractable head and foot sections for easier shipment in a relatively small container that may be assembled by the purchaser without any tools. The bed includes a central frame with telescopic head and foot sections that linearly retract into the central frame. The central frame houses the head and foot drive motors, linear actuators, and rocker shafts that pivot mattress support panels upwardly from the extended frame.

9 Claims, 3 Drawing Sheets

ARTICULATED BED WITH COLLAPSIBLE FRAME

RELATED APPLICATIONS

This application is related to U.S. patent applications, U.S. Ser. No. 597,525, Filed Oct. 15, 1990 entitled "POWER MODULE FOR AN ARTICULATED BED" now U.S. Pat. No. 5,063,623 and U.S. Ser. No. 308,412 Filed Sep. 19, 1994 entitled "AN ARTICULATED BED WITH FRAME MOUNTED POWER MODULE" both assigned to the assignee of the present invention.

BACKGROUND OF THE INVENTION

Articulated beds have only recently achieved significant commercial success in the residential market and previously such beds were marketed for the most part as hospital or nursing home products and with such objectives were over-designed and overly complicated and as a result too costly for the residential or home market.

Over the last several decades, articulated chairs and sofas have achieved some commercial success in the residential market but only recently has such technology been adapted for the residential articulated bed marketplace.

A primary consideration in the design of articulated beds, and components therefor in the residential market, is ease of shipment because a container the size of an entire assembled articulated bed would not only be excessively large but too heavy for one delivery person to bring into the home and install.

One attempt at solving this problem is illustrated in the Elliott, U.S. Pat. No. 4,381,571 which shows an articulated mattress spring that is adapted to fit on top of and rest on a separate simple rectangular bed frame. The Elliott mattress frame includes large stationary "L" shaped side sections with cross members to provide support for axially oriented motor and screw assemblies that drive complicated four bar linkages at the four corners of the module that serve to raise and lower the head and leg sections of the mattress support. While Elliott suggests that these parts, numbering literally hundreds, may be disassembled for shipment, it is realistically not practical to have the purchaser reassemble this complex device in his or her home.

A similar articulated bed is illustrated in the Neumann, U.S. Pat. No. 4,120,057 and it shows a power system for an articulated mattress support and, like the Elliott design, is adapted to fit into a bed frame. The problem with the Neumann device is that it requires a large rectangular frame the size of the bed frame itself so that no size reduction is practically possible in the Neumann system.

Furthermore in the Elliott device the power module with drive motors, gearing and rocker shafts, requires that the rocker shafts be mounted in outboard bearings, i.e. bearings in the large rectangular frame described above and such outboard bearings denigrate from the capability of shipping the bed in easily carried containers without requiring any significant reassembly at the purchaser's location.

Other articulated beds are illustrated in the Muir, U.S. Pat. No. 1,397,773 and the Szemplack, et al., U.S. Pat. No. 3,051,965. The patent to Muir also shows a device for adjusting the articulated bed. Double motor-type systems are shown in the Taylor, U.S. Pat. No. 2,500,742. Another standard articulated bed frame is illustrated in Hanning, et al., U.S. Pat. No. 3,921,230.

In the related application, U.S. Ser. No. 597,525, now U.S. Pat. No. 5,063,623, we disclose a power module for an articulated bed assembly that fits into a completely standard bed frame. A mattress support is provided that has wooden planar panels hinged to one another with a stationary central section adapted to be bolted to the top of the standard bed frame, a pivotal head section connected to the central section, and pivotally interconnected thigh and foot sections. The power module has an elongated housing that supports separate electric drive motors, one for the head section and one for the thigh and foot sections. Drive gearing in the module transmits power from the motors to transversely mounted rocker shafts that have rocker arms at the ends thereof that respectively pivot the head and leg sections upwardly and downwardly with a suitable wand-type control that reversely controls the two motors.

In this prior application, the power module is connected to the underside of the central stationary section of the mattress support.

In the other related application, U.S. Ser. No. 308,412 Filed: Sep. 19, 1994, an articulated bed having a modified standard bed frame is described that supports an independent power module replaceable without disassembly of the frame. The modified frame is of the well-known horizontally collapsible angle iron-type with castered legs. The framing includes a pair of side rails each having head and foot rail portions pivotally connected thereto at their ends for packing and shipping, that interengage one another when assembled in the home.

The frame has inverted side rails so that the horizontally flat parts of the angle irons are on top, and its legs are somewhat lengthened to accommodate the underslung power module. After the frame is assembled in the home, a pair of "U" shaped cross members are attached across the frame and the power module is affixed to the tops of these cross members.

This design has many of the advantages of the power module and standard bed frame disclosed in our related application, U.S. Ser. No. 597,525 now U.S. Pat. No. 5,063,623.

It is a primary object of the present invention to provide an improved articulated bed assembly that is easier to ship and assemble than prior articulated beds.

SUMMARY OF THE PRESENT INVENTION

In accordance with the present invention, an improved articulated bed is provided that collapses for easier shipment in a relatively small container, and it may be assembled by the purchaser without any tools.

The bed includes a central frame which is essentially the collapsed size of the entire bed, with linearly telescopic head and foot sections that retract into this central frame for shipment. The central frame section houses the head and foot drive motors, linear actuators, and rocker shafts that pivot hinged mattress support panels carried on top of the three frame sections.

A plurality of spring load detent mechanisms selectively lock the telescopic head and foot sections in either their retracted or extended positions eliminating the necessity for any tools for either frame extension or retraction.

Other objects and advantages of the present invention will appear more clearly from the following detailed description.

DETAILED DESCRIPTION OF THE PREFERRED EMBODIMENT

Figure 1:
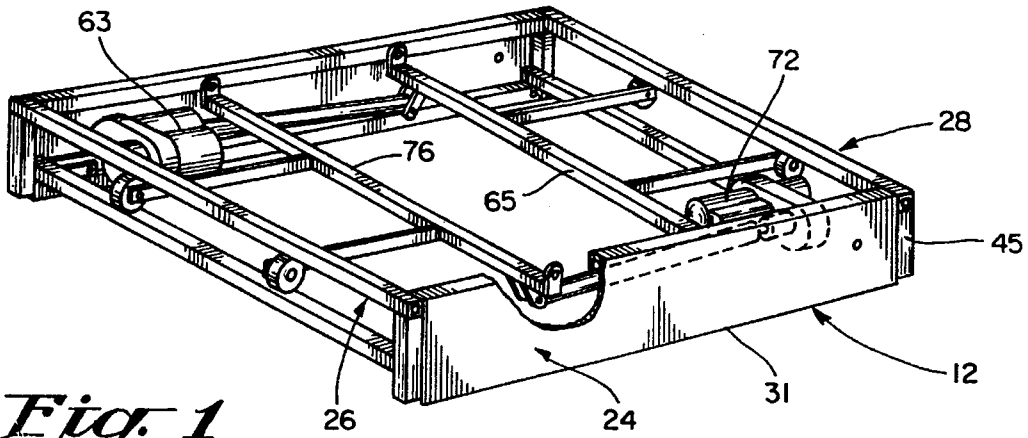
FIG. 1 is a perspective view of the frame of the present articulated bed in its collapsed position.
Figure 3:
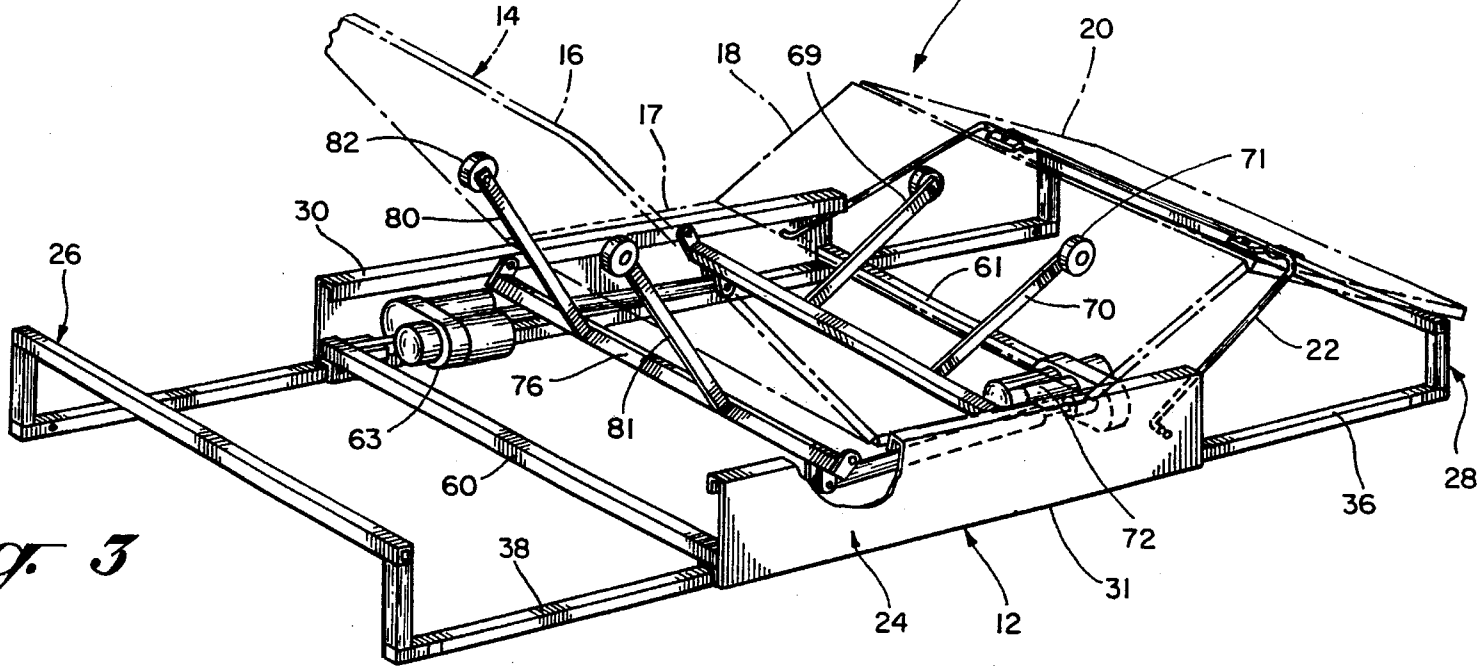
FIG. 3 is a perspective view similar to FIG. 2 with the mattress support illustrated in its raised position.
Figure 2:
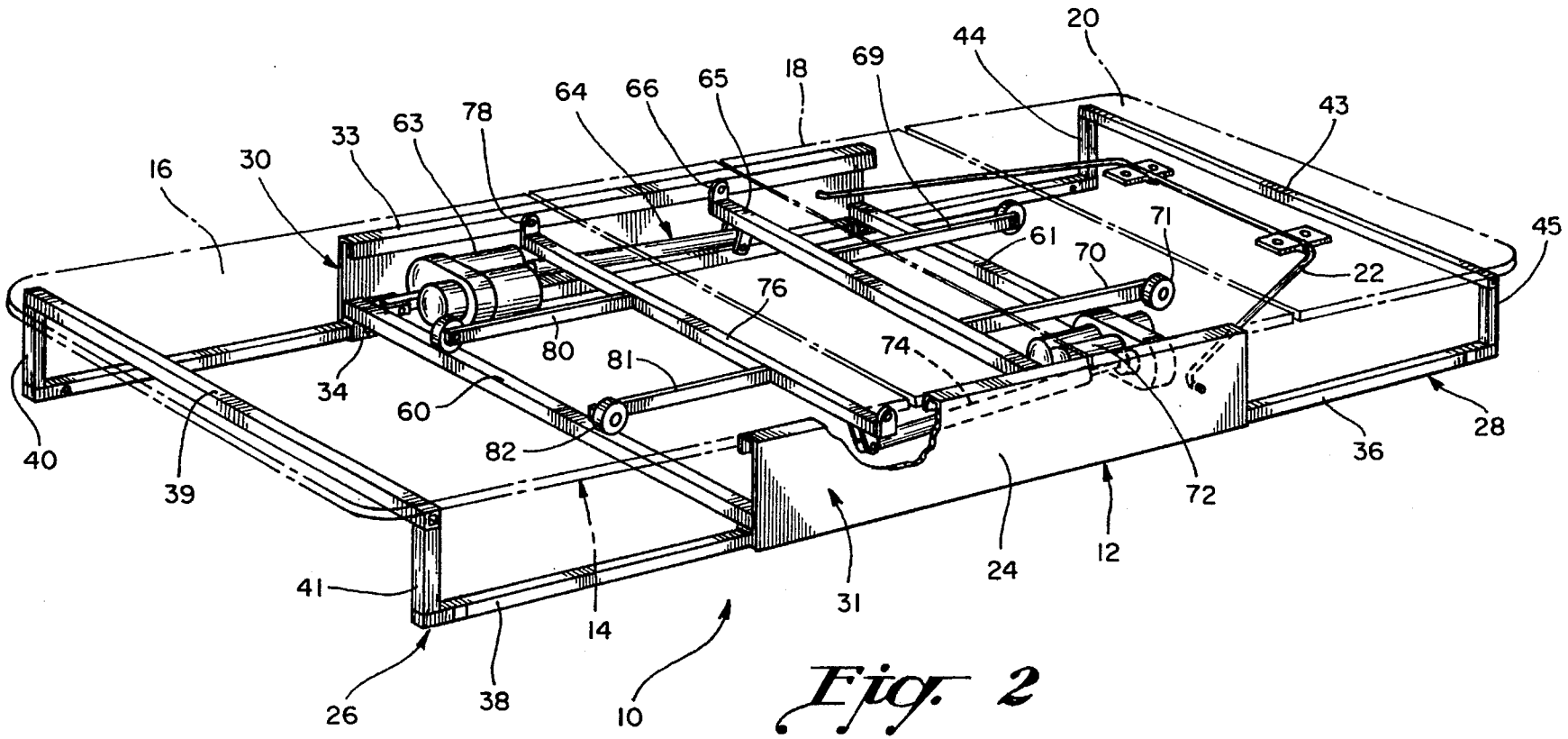
FIG. 2 is a perspective view of the present articulated bed with the head and foot sections extended and a mattress support illustrated in dotted lines.

Referring to the drawings and particularly FIGS. 1 to 3, the present collapsible articulated bed 10 is seen to include an extendable collapsible bed frame assembly 12 which supports a hinged panel mattress support 14 shown in dotted lines in FIGS. 2 and 3 and consisting of a head panel 16 hinged to a seat panel 17 fastened by suitable fasteners to frame 12, a thigh panel 18 hinged to seat panel 17 and a foot panel 20 hingedly connected to thigh panel 18 and supported on frame 12 by a 6 shaped pivot rod 22.

The bed frame assembly 12 includes a central frame section 24, a head frame section 26 telescopically mounted in central frame section 24, and a foot frame section 28 also telescopically mounted in central frame section 24. The frame 12 may be positioned in the side frame members of a standard legged and castered bed frame or alternatively may be rested directly on the floor.

As seen best in FIG. 2, the central frame 34 consists of mirror image side channels 30 and 31 each having a downwardly opening top channel portion 33 and a boxed in lower channel portion 34 that defines guides for the legs of the head and foot sections 26 and 28.

Figure 4:
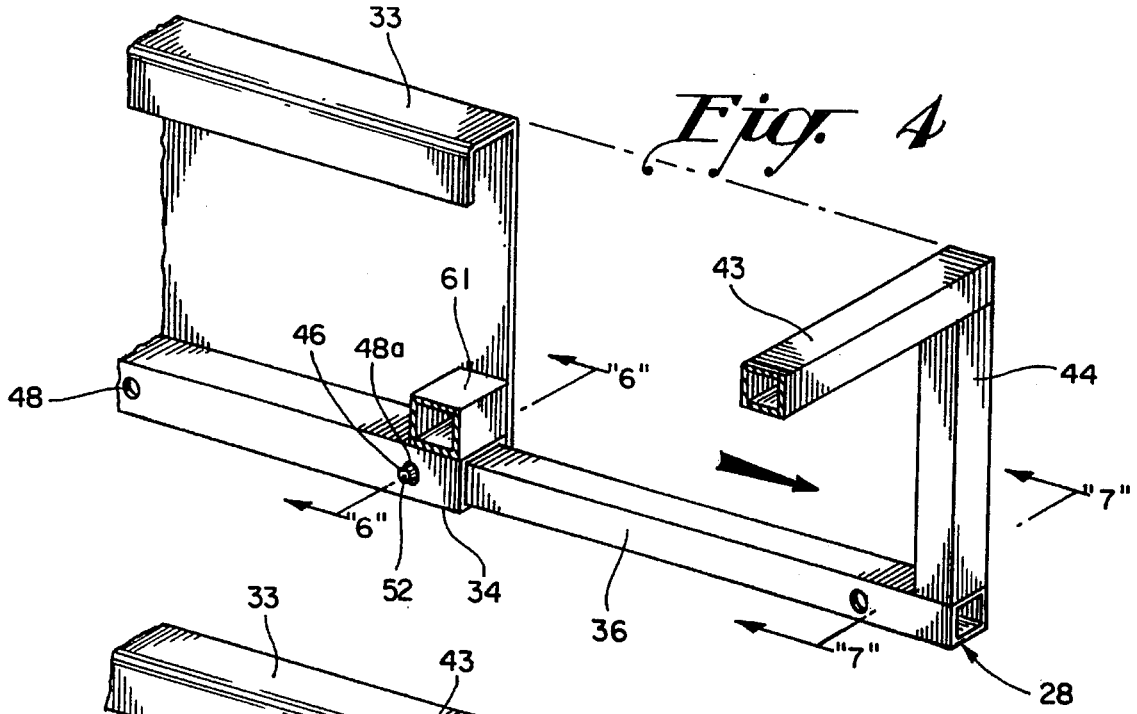
FIG. 4 is a fragmentary perspective of one side of one of the extendable head and foot sections illustrating the two detent assemblies.

More specifically, the channel portions 34 have a substantially square internal configuration that receive, as seen in FIG. 4, the parallel rectangular tubular legs 36 forming part of the foot section 28. The other ends of channel portions 34 receive the parallel tubular legs 38 in the head frame 26. The head section 26 and the foot section 28 are substantially the same and have the same horizontal width and substantially the same horizontal length but the length of each may be changed somewhat as desired. The legs of the head frame are aligned with the legs in the foot frame so they cannot overlap in the guides 34 of central frame section 24. Head section 26 consists of a rectangular tubular cross frame 39 having downwardly depending similarly sectioned leg portions 40 and 41 each fixedly connected to one of the horizontally extending legs 38.

Similarly foot section 28 is constructed of the same tubular members as head section 26 and includes cross member 43 connected to downwardly depending leg portions 44 and 45 that in turn are connected to the legs 36.

Figure 5:
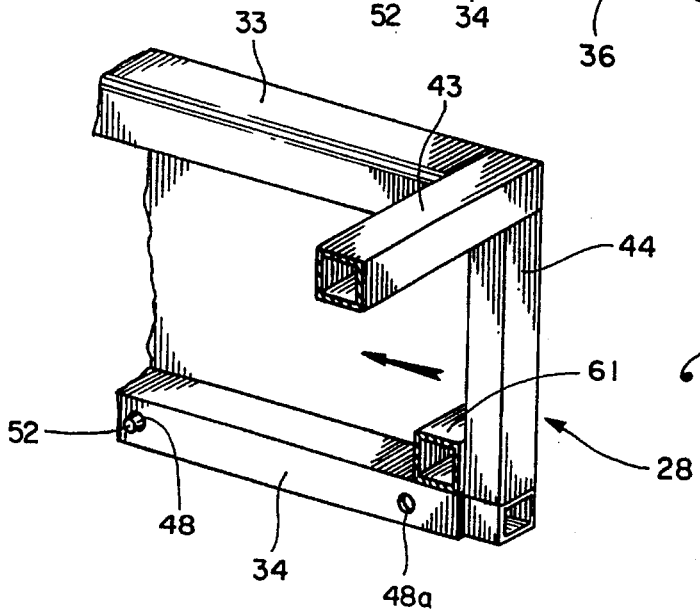
FIG. 5 is a fragmentary perspective of one corner of the central frame with the adjoining telescopic frame shown in FIG. 4 completely removed.

When collapsed as seen in FIGS. 1 and 5, leg portions 44 are substantially flush with the outside of the central frame section 24 and cross member 43 is substantially flush with the top of the central frame upper channel portions 33. The head section 26 collapses to the same position on central frame 24 providing a compact and projection free frame assembly for shipping.

A pair of spring biased detent assemblies 46 and 47 is provided in each of the legs 36 and 38 to lock the legs in either the collapsed positions illustrated in FIGS. 1 and 5 or the extended positions illustrated in FIGS. 2, 3 and 4.

Figure 6:
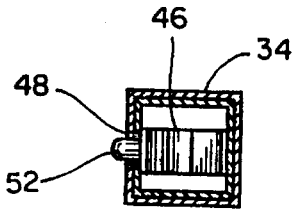
FIG. 6 is a cross-section showing one detent assembly engaged with the central frame taken generally along line 6—6 of FIG. 4.
Figure 7:
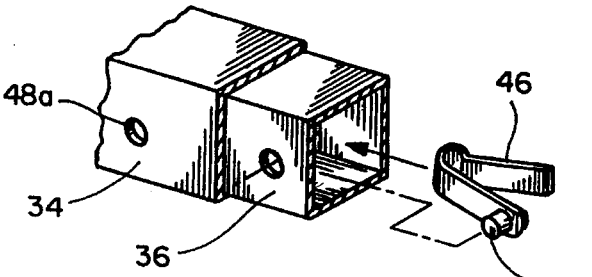
FIG. 7 is a fragmentary perspective of one of the other detent assemblies on each side of each telescopic frame taken generally along line 7—7 of FIG. 4.

The detent assemblies 46 and 47, as seen in FIGS. 6 and 7, include spring biased detent that selectively snap through one of the holes 48 and 48*a* at each end of each of the guides 34.

The purchaser receives the bed in the collapsed position illustrated in part in FIG. 5. By pressing the detent 52, and at the same time pulling slightly outwardly on the head and foot sections, the detent 52 will be held inoperative by the guides 34 and thereafter the cross members 39 and 43 are pulled outwardly (not at the same time) until detent 52 automatically snaps into the opposed aligned holes 48 or 48*a* thereby locking the head and foot sections in the extended positions illustrated in FIGS. 2, 3 and 4. Both the head and foot sections may be thereafter easily collapsed when desired simply by pushing in on detents 51 and pushing the head and foot sections toward the central frame 24 until legs 40, 41, 44 and 45 engage the central frame side channels 30 and 31.

The central frame side channels 30 and 31 are held together and spaced apart by tubular cross members 60 and 61 which are welded to the tops of the lower slides 34.

A mattress leg panel motor drive 63 is pivotally mounted on cross member 60 which drives a rotary screw and tube assembly 64 together defining a linear actuator for pivoting a tubular rocker shaft 65 pivotally mounted to the side frame upper channel portions 33 by offset flanges 66 at each end thereof. The rocker shaft 65 carries a pair of rocker arms 69 and 70 with rollers at 71 at their distal ends that engage the underside of thigh panel 18 to raise and lower the thigh panel along with the connected foot panel 20 as the motor drive 63 reciprocates linear actuator 64.

A similar linear actuator pivots the head panel 16 of the mattress support including a motor drive 72 pivotally carried by cross member 61. Motor drive 72 drives a rotary screw and tube assembly 74 that in turn is connected to a rocker shaft 76 pivotally mounted on side upper channel portions 33 by offset flanges 78. Rocker shaft 76 carries a pair of rocker arms 80 and 81 that have rollers 82 at the distal ends thereof that engage the underside of the mattress head panel 16 to raise and lower that head panel as desired.

We claim:

1. An articulated bed with an expandable frame, comprising: a generally rectangular main frame adapted to fixedly receive a stationary panel of an articulated mattress support having at least one other panel pivotally mounted to the fixed panel, a drive motor fixed to the main frame and a linear device driven by the motor, a pivot arm on the main frame driven by the linear drive positioned to pivot the pivotally mounted mattress panel, and an extendable co-planar frame carried by the main frame movable from a first position mounted within the main frame to a second extended position defining with the main frame the entire support for the mattress support.

2. An articulated bed with an expandable frame as defined in claim 1, including first and second detent assemblies on the main frame and the co-planar frame for locking the co-planar frame in its first and second positions with respect to the main frame.

3. An articulated bed with an expandable frame as defined in claim 1, wherein the co-planar frame includes a head frame telescopically mounted in the main frame.

4. An articulated bed with an expandable frame as defined in claim 1, wherein the co-planar frame includes a foot frame telescopically mounted in the main frame and movable when extended to define the foot end of the bed frame.

5. An articulated bed with an expandable frame as defined in claim 1, wherein the mattress support fixed panel is a seat panel fixed to the main frame, said other pivotal panel including a head panel pivotally mounted to the seat panel and a leg panel pivotally mounted to the seat panel, said pivot arm being connected to pivot the mattress head panel, a second drive motor carried by the main frame and a second linear drive driven by the second motor, a second pivot arm on the main frame driven by the second linear drive positioned to pivot the leg panel.

6. An articulated bed having a horizontally expandable frame, comprising: a generally rectangular main frame, a head frame telescopically carried by the main frame and movable from a first position mostly within the main frame to a second extended position defining the frame for the head end of the bed, a foot frame telescopically carried by the main frame and movable from a first position mostly within the main frame to a second extended position defining the frame for the foot end of the bed, a foldable mattress support releasably mounted on the frame including a seat panel fixedly carried by the main frame, a head panel pivotally carried by the seat panel and engageable when lowered with the head frame, a foot panel pivotally carried by the seat panel and engageable when lowered with the foot frame, first and second rocker shaft and arm assemblies for pivoting the head and foot panels, and motor means for driving the first and second rocker shaft and arm assemblies.

7. An articulated bed having a horizontally expandable frame as defined in claim 6, wherein each of the head and foot frame have detent assemblies to lock them in the first and second positions with respect to the main frame.

8. An articulated bed having a horizontally expandable frame as defined in claim 6, wherein the first and second rocker shaft and arm assemblies are mounted on the main frame, said motor means including a first motor mounted on one end of the main frame for pivoting the first rocker shaft and arm assembly mounted at the other end of the main frame, and a second motor mounted at the other end of the main frame for pivoting the second rocker shaft and arm assembly mounted at the one end of the main frame.

9. An articulated bed having a horizontally expandable frame, comprising: a generally rectangular main frame, a head frame telescopically carried by the main frame and movable from a first position mostly within the main frame to a second extended position defining the frame for the head end of the bed, a foot frame telescopically carried by the main frame and movable from a first position mostly within the main frame to a second extended position defining the frame for the foot end of the bed, a foldable mattress support releasably mounted on the frame including a seat panel fixedly carried by the main frame, a head panel pivotally carried by the seat panel and engageable when lowered with the head frame, and a foot panel pivotally carried by the seat panel and engageable when lowered with the foot frame, first and second rocker shaft and arm assemblies for pivoting the head and foot panels, motor means for driving the first and second rocker shaft and arm assemblies, each of the head and foot frames having detent assemblies to lock them in the first and second positions with respect to the main frame, the first and second rocker shaft and arm assemblies being mounted on the main frame, said motor means including a first motor mounted on one end of the main frame for pivoting the first rocker shaft and an assembly mounted at the other end of the main frame, and a second motor mounted at the other end of the main frame for pivoting the second rocker shaft and arm assembly mounted at the one end of the main frame, said head frame and said foot frame being generally "U" shaped and tubular in section.

* * * * *